United States Patent [19]

Csizy et al.

[11] 4,053,862

[45] Oct. 11, 1977

[54] FUSE-ELEMENT FOR FUSES USED IN ELECTRIC NETWORKS

[75] Inventors: Tibor Csizy; Árpád Karpát; János Melis, all of Budapest, Hungary

[73] Assignee: Villamos Berendezës ës Keszülek Müvek, Budapest, Hungary

[21] Appl. No.: 655,492

[22] Filed: Feb. 5, 1976

[30] Foreign Application Priority Data

Feb. 10, 1975 Hungary ..... VI 1027

[51] Int. Cl.[2] ..... H01H 85/02; H01H 85/46

[52] U.S. Cl. ..... 337/221; 337/164

[58] Field of Search ..... 337/4, 157, 156, 221, 337/416, 220, 142, 143, 163, 164, 165, 166, 295, 160

[56] References Cited

U.S. PATENT DOCUMENTS

| | | | |
|---|---|---|---|
| 2,638,788 | 7/1954 | Hoorn | 337/166 |
| 2,667,551 | 1/1954 | Berthel | 337/166 |
| 3,122,619 | 2/1964 | Fister | 337/164 |

*Primary Examiner*—Harold Broome

*Attorney, Agent, or Firm*—Ernest F. Marmorek

[57] ABSTRACT

A fuse-element for use in an electric network, includes a metal strip including at least one portion having a reduced cross-section, a shunt element of conductive material shunting the portion, bonding means conductively bonding the shunt element to the metal strip and being capable of being released at a temperature higher than a predetermined temperature, the shunt element defining a chamber facing towards the metal strip and being sealed by the bonding means between the metal strip and the shunt element, and a material disposed in the chamber having a boiling temperature below the predetermined temperature and capable of producing an internal gas pressure within the chamber sufficient to break the bond when the material is heated to a temperature higher than the boiling temperature.

6 Claims, 7 Drawing Figures

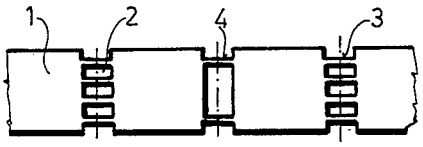
Fig. 1
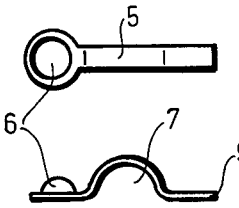
Fig. 2a
Fig. 2b
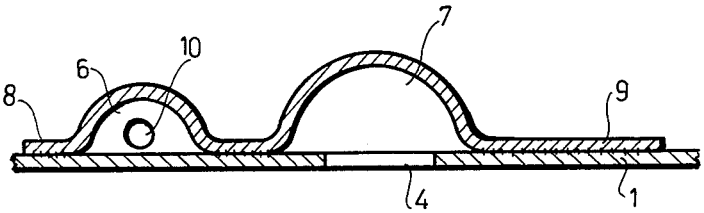
Fig. 3
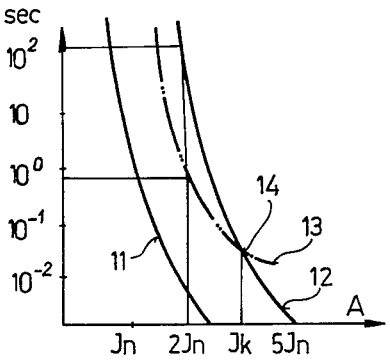
Fig. 4
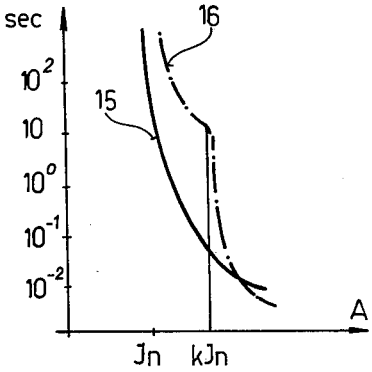
Fig. 5
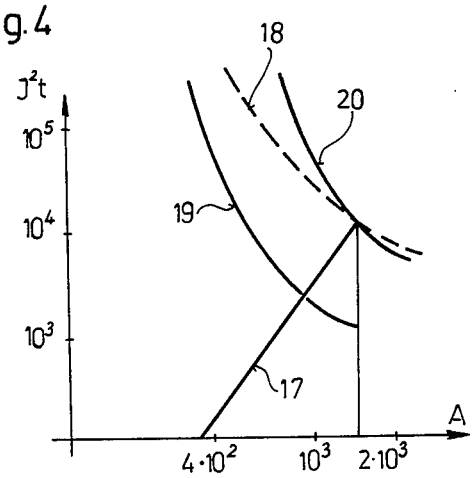
Fig. 6

FUSE-ELEMENT FOR FUSES USED IN ELECTRIC NETWORKS

The invention is related to a fuse-element for fuses of electric networks that is shaped as a metal strip comprising one or more zones of diminished cross-section..

A fuse for electric networks consists of one or more fuse-elements arranged between two parts to be coupled together.

In fuses according to prior art, the fuse-element is shaped as a wire or a metal strip. If it is shaped as a metal strip, the value of the rated current and the characteristic of the fuse-element is set in a known manner by diminishing the cross-section of the metal strip along one or more equal zones.

An inert-quick melting characteristic can be obtained by coating a zone of the metal strip with a metal or metal alloy of low melting point; in case of overload the metal or metal alloy will melt and in its melted state diffuse into the metal strip increasing its resistance, causing local heating and time-dependent melting. It is a disadvantage of this method that the melting characteristic of the fuse-element is after multiple overload and as a consequence of the gradual diffusion varying so that the features of the fuse-element become impaired in the course of work.

The features of the fuses developed in order to protect electric networks are usually specified by three characteristics. The melting (operating) time/current characteristic makes it possible to classify the fuses according to three main types i.e. the inert (time-lag) type, the quick-break type and the superquick-break type. Time-lag fuses are generally used if short-time current impulses of high intensity occur during which the fuse must not melt whereas a quick operation is required if the current exceeds a given value, especially in the case of short-circuit. In order to meet this requirement as far as possible, a fuse-element type has been developed the characteristic of which is called inert-quick. This type should also be apt to be used in combination with circuit-breakers but its characteristic is very different from the one of the circuit-breakers so that only a disadvantageous co-ordination is possible where the rated current of the co-ordinated fuse must be much less than the maximum current allowable in the mains.

Quick-break fuses are generally used to protect the mains. Used for this purpose, they are very important as protective devices against electric shock. In networks equipped with neutral wire, a maximum operating time of 5 s is in case of earth leakage a standardized requirement. For the time being this requirement can only be met if the rated current of the fuse is much less than the maximum current allowable in the mains.

Superquick-break fuses have especially been developed for the protection of semiconductor devices but even this type can only be considered as working "superquickly" if the current is three or four times as much as the rated current.

A further important feature of the fuses is shown in the $I^2t$ (Joule integral) characteristic giving $I^2t$ values as a function of prospective current. The designer can, thus, establish the thermic load occurring in the network to be protected in case of short-circuit and choose a suitable fuse for the system to be protected. This characteristic shows also the possibility of co-ordination with automatic circuit breakers or to be more precise it shows the value of rated current a fuse must be of if it is intended to be co-ordinated with an automatic circuit breaker of a certain breaking capacity.

A third important feature of the fuses is shown in the characteristic giving the cut-off current as a function of the prospective breaking current. This is a very important information for the designer concerning both the thermic and the dynamic load.

Out of the features specified above there is a specially important one i.e. that part of the time/current characteristic which includes the small current values. The uncertainty of operation within this range must be avoided, therefore it became a usual — and nowadays a standardized — requirement that the fuse must not melt if the current value is 1.2–1.3 times as much as its rated current.

Besides a very important factor shall also be taken into consideration. Quick-break and superquick-break fuses are everywhere made of silver since silver affords the lowest melting temperature and evaporation heat as far as metals of high conductivity are concerned.

Comparing the features of the fuses set forth above with the practical requirements, the following conclusions can be drawn therefrom:

1. It can be seen in the melting characteristics of quick-break fuses that they can only be considered "quick-breaking" if the current exceeds a value 4–7 times as much as their rated current; at a current value twofold the rated current the melting time increases up to about a minute. It would especially for the protection of semiconductor devices be desirable to obtain a quick-break fuse with the following characteristic: at a current being twice the rated current the melting time shall be about hundred times shorter than the one of the quick-break fuses available nowadays at the market whereas if the current is only 1.2–1.3 times as much as the rated current, the fuse must not melt or, if it melts, that shall only occur after a considerably long time.

2. For quick-break fuses silver is always used; the possibility of using the much cheaper copper is desirable.

3. It is a disadvantage of the inert-quick fuses that diffusing metal alloys are applied and, thus, the resistance and the characteristic of the fuse-element is varying during operation to such a measure that some time later the fuse will melt even at rated current. It would be expedient to obtain an inert-quick characteristic without causing a diffusion process.

4. Tests on co-ordination of fuses with circuit breakers have shown that the melting characteristic of the fuse and the breaking characteristic of the circuit breaker are differing to such a measure that for the time being no ideal co-ordination can be performed, furthermore, the Joule integral of the inert-quick fuses is a very high one so that a circuit breaker of a certain rated breaking capacity can only be co-ordinated with a fuse the rated current of which being much less than the maximum current allowed in the network. One way to overcome this difficulty consists in extending the capacity of the mains but this is very expensive (in a whole country the expenses of such extension are in the scale of milliards of the currency unit). Another way is the developing of a fuse the Joule integral of which being much less than the one of the fuses available at the market.

The invention has been developed in order to meet the requirements as set forth above in points 1 to 4.

The fuse-element according to the invention is shaped as a metal strip comprising one or more zones of diminished cross-section. The improvement consists in that at least one of said zones of diminished cross-section is bridged over by a shunt of conductive material and said shunt is fastened to the metal strip by a bond dissolving if the fuse-element is heated by a current of pre-determined value.

In a preferred embodiment of the invention a chamber is incorporated into the bond between the metal strip and the shunt and said chamber is sealed by the agent performing the bond between the metal strip and the shunt, e.g. by a solder, and said chamber is filled with a stuff (e.g. iodine, sulphur) the boiling point of which being of a value lower than the melting temperature of the bonding agent (e.g. tin-lead solder) sealing said chamber.

The chamber can also contain another stuff (e.g. zinc) the melting temperature of which being of a value lower than said boiling point that is lower than the melting temperature of the bonding agent.

If the fuse-element comprises more than one zones of diminished cross-section, it is expedient to bridge over by the shunt that one of the zones of diminished cross-section that lies next to the end of the metal strip.

The invention will now be described more particularly with reference to the accompanying drawings.

FIG. 1 shows the part of a fuse-element according to the invention in a way that the zones of diminished cross-section can be seen.

FIGS. 2*a* and 2*b* show a preferred embodiment of the shunt.

FIG. 3 shows a way of fixing the shunt to the metal strip.

FIGS. 4, 5 and 6 show the characteristics of fuses according to the invention.

The preferred embodiment of the fuse-element 1 as shown in FIG. 1 comprises the zones of diminished cross-section 2 and 3 applied in order to set the rated current of the fuse-element 1. A further zone 4 is of a smaller cross-section than the zones 2 and 3 so that it melts quickly even if the current is lower than the rated current.

But said zone 4 is bridged over by the shunt 5 (FIGS. 2*a* and 2*b*). This shunt 5 comprises a broader part where a depression (a cap) 6 is shaped. The other end of the shunt 5 consists in a narrower straight part 9 whereas the middle part of the shunt i.e. the part lying between the straight part 9 and the margin 8 of the cap 6 is shaped as a bow 7.

The mounting of the shunt 5 to the fuse-element 1 is shown in FIG. 3. It can be seen that the bow 7 of the shunt 5 is bridging over the zone 4 of diminished cross-section whereas the shunt 5 is soldered to the fuse-element 1 at the margin 8 of the cap 6 and along its straight part 9. A solder of a certain melting point is used.

A part of the surface of the shunt 5 — i.e. the surface of the straight part 9 and the margin 8 of cap 6 — rests flat against the fuse-element 1. Its dimension is large enough to ensure that its contact resistance — taking also into consideration the diffusion of the solder — is essentially lower than the resistance of bow 7.

Before fastening the shunt 5 to the fuse-element 1, a solid or liquid stuff 10 (hereinafter referred to as starter) e.g. iodine or zinc + sulphur is put into the cap 6 said starter 10 being of a nature as to change its state (i.e. changing from solid or liquid state to gassy consistence or vapouring or volatilizing) a pre-determined temperature or within a very narrow temperature range in a way that the change of state of a considerable stuff volume produces a large pressure inside said cap 6.

The solder used to establish the bond between the shunt 5 and the fuse-element 1 is of a type having a higher melting temperature than the temperature causing a change of state of the starter 10. Taking into consideration the strength characteristics of both the solder and the surface of the margin 8 of said cap 6, it can be ensured by proper designing that the sudden increase of pressure caused by the starter 10 does not impair the shape of the fuse-element 1 and the shunt 5 but effects the detachment of the shunt 5 from the fuse-element 1. The dimensions of the shunt 5, and especially the size of bow 7, shall be chosen according to the requirement that the temperature in the vicinity of the starter 10 must not reach the boiling point of said starter 10 (i.e. the temperature causing a change of its state) until the current does not exceed a value 1.2–1.3 times as much as the rated current of the fuse-element 1.

Dependent on the difference between the working temperature as produced by the rated current and the temperature causing a change of state of the starter 10, the ratio of smallest fusing current to rated current can be varied within a large range. FIG. 4 shows the time/-current characteristic of a fuse-element according to the invention as shown in FIG. 1 and FIG. 3. The characteristic of the cross-section in zone 4 of the fuse-element 1 is given by the curve 11 whereas the one of the cross-section in zones 2 and 3 is given by the curve 12. The latter one corresponds with the characteristic as usual for fuse-elements belonging to prior art and designed for a certain rated current $I_n$, e.g. of the quick-break type. The curve 13 is giving the total of the time necessary for both the change of state of the starter 10 and the detachment of the shunt 5 from the fuse-element 1 as a function of the load current. It can be seen from this curve that the melting time of a quick-break fuse-element according to prior art is of a magnitude of about 100 s if the current is twice the rated current. At the same load current, the operating time of the starter 10 (including the time for both the vapouring and the detachment of the shunt) is lower than 1 s, and this is only increased by the melting time as shown in curve 11 being negligible if compared with 1 s. Thus, the total operating time of a fuse-element according to the invention is reduced to about a hundredth of the one according to prior art.

The resultant characteristic of a fuse-element combined with said shunt is approximately the equal of the characteristic of the starter until the load current does not exceed the critical value $I_k$. If the current increases over this value $I_k$ the characteristic continues as the equal of the curve 12 since in this range the zones 2 and 3 of the fuse-element will melt before the operation of the starter becomes effective.

In certain cases the bridging over of more than one zone of diminished cross-section may be necessary owing to the distribution of the arc voltage.

The stuff used as starter can be a compound of two or more components.

If, e.g., a two component starter is used, a characteristic as shown — as example — in FIG. 5 can be obtained. In this case the first component is of a nature as to fulfill the following requirements:

it is in solid state at the working temperature of the fuse-element, i.e. at normal current;

the difference between its melting temperature and the normal working temperature of the whole fuse-element on the one hand and the volume of the component on the other hand are related to each other in a manner that the total heat necessary for both heating said component and entirely melting it is the equal of the heat produced if a current $k$ ($k = 1, 2, 3, \ldots$) times as much as the rated current $I_n$ is flowing during a pre-determined time interval, i.e. the wanted lag.

Within this time interval the temperature of this component rises continuously up to its melting point and remains then constant until the whole volume of the component is molten. In this temperature (current) range, the characteristic of the fuse (s. curve 16 of FIG. 5) is of the time-lag type.

The second component of the two component starter is chosen in a manner that its boiling point or its flash point is a thought higher than the melting temperature of the first component whereas its evaporation heat is as low as possible. If all of the first component is molten, the temperature of the starter rises again. At the boiling point or flash point of the second component a quick vapouring or burning out of this second component occurs causing the detachment of the shunt from the fuse-element. In this temperature (current) range the characteristic of the fuse (shown by curve 16) is of the quick-break type.

The curve 15 of FIG. 5 shows the melting characteristic of a fuse without shunt.

The characteristic shown by curve 16 shows an ideal likeness to the one of the circuit breakers so that a proper co-ordination of fuse and circuit breaker is made possible. FIG. 6 shows the $I^2$/prospective current characteristic of an automatic circuit breaker of a breaking capacity of 1500 A (curve 17), of a 50 A inert-quick fuse according to prior art (curve 18), and of two fuse-elements according to the invention equipped with a two component starter, i.e. a fuse-element for 50 A rated current (curve 19), and one for 160 A rated current (curve 20). It can be seen that the co-ordination of an automatic circuit breaker with a fuse-element equipped with a two component starter makes it possible to increase the capacity of a mains to the multiple of its original capacity.

What we claim is:

1. A fuse-element for use in an electric network, comprising, in combination:

a metal strip including at least one portion having a reduced cross-section;

a shunt element of conductive material shunting said portion bonding means conductively bonding said shunt element to said metal strip and being capable of being released at a temperature higher than a predetermined temperature;

said shunt element defining a chamber facing towards said metal strip and being sealed by said bonding means between said metal strip and said shunt element; and a material disposed in said chamber having a boiling temperature below said predetermined temperature and capable of producing an internal gas pressure within said chamber sufficient to break said bond when said material is heated to a temperature higher than said boiling temperature.

2. The fuse-element as claimed in claim 1, wherein said material is a mixture of components having different boiling temperatures all below said predetermined temperature.

3. The fuse-element as claimed in claim 2, wherein said material comprises iodine and sulphur.

4. The fuse-element as claimed in claim 2, wherein said material comprises zinc and sulphur.

5. The fuse-element as claimed in claim 2, wherein said bonding means is a tin-lead solder.

6. A fuse-element as claimed in claim 5, wherein said metal strip comprises a plurality of said portions and said shunt element is shunting the portion next to one end of said metal strip.

* * * * *